US005609234A

United States Patent [19]

Walker et al.

[11] Patent Number: 5,609,234

[45] Date of Patent: Mar. 11, 1997

[54] COIN VALIDATOR

[76] Inventors: Robert S. Walker, 2 Chelwood Drive Little Sandhurst, Camberley, Surrey, United Kingdom, GU17 8HT; Timothy P. Waite, 31 Severn Drive Hinchley Wood, Esher, Surrey, United Kingdom, KT10 0AJ

[21] Appl. No.: 331,594

[22] PCT Filed: May 5, 1993

[86] PCT No.: PCT/GB93/00929

§ 371 Date: Nov. 4, 1994

§ 102(e) Date: Nov. 4, 1994

[87] PCT Pub. No.: WO93/22747

PCT Pub. Date: Nov. 11, 1993

[30] Foreign Application Priority Data

May 6, 1992 [GB] United Kingdom ..... 9209737

[51] Int. Cl.[6] ..... G07D 5/08

[52] U.S. Cl. ..... 194/317; 194/210

[58] Field of Search ..... 194/210, 317, 194/318, 334, 338

[56] References Cited

U.S. PATENT DOCUMENTS

| | | | |
|---|---|---|---|
| 4,742,903 | 5/1988 | Trummer | 194/317 |
| 4,870,360 | 9/1989 | Collins | 324/235 |

FOREIGN PATENT DOCUMENTS

| | | | |
|---|---|---|---|
| 0072655 | 2/1983 | European Pat. Off. . | |
| 0076617 | 4/1983 | European Pat. Off. . | |
| 0202378 | 11/1986 | European Pat. Off. . | |
| 0359470 | 3/1990 | European Pat. Off. . | |
| 2538934 | 7/1984 | France . | |
| 3605802 | 8/1987 | Germany . | |
| 1491130 | 11/1977 | United Kingdom . | |
| 1578767 | 11/1980 | United Kingdom . | |
| 87/00662 | 1/1987 | WIPO | 194/317 |
| 91/15003 | 10/1991 | WIPO . | |

*Primary Examiner*—F. J. Bartuska
*Attorney, Agent, or Firm*—Fish & Richardson P.C.

[57] ABSTRACT

A coin validator has a sensor circuit including two sensor coils each of small diameter, the coils being positioned such that they are passed in succession by a coin moving through a test section of the validator. The sensor circuit derives a signal representing the difference between the coil outputs so that bimetallic coins having a different outer ring material from the core material are easily detected.

13 Claims, 3 Drawing Sheets

COIN VALIDATOR

FIELD OF THE INVENTION

This invention relates to apparatus for validating coins.

BACKGROUND OF THE INVENTION

It is known to provide in such apparatus one or more inductive sensors which generate electromagnetic fields in a test region through which a coin is arranged to travel. The coin influences the field to an extent dependent upon the dimensions and/or material of the coin. The inductive sensor, and the circuit to which it is coupled, may be arranged so that the influence of the coin on the electromagnetic field is predominantly determined by the coin material, the coin diameter or the coin thickness. The inductive sensors tend to be of a size comparable to that of the coins which they are intended to validate, to ensure sufficient sensitivity. This, coupled with the fact that the electromagnetic fields generate eddy currents throughout the body of the coin, results in the inductive sensors tending to be responsive to the bulk or average properties of the coin. Some coins, however, are formed of a composite of two or more materials, such as a central core of a first metal surrounded by one or more outer rings of a second or respective further types of metal. Conventional sensors cannot easily discriminate between these bimetallic (or, in general, multi-metallic) coins and homogeneous coins made of a material which influences the sensor to substantially the same extent as the average influence produced by materials of the non-homogeneous coins. Also, because the sensors can detect effects on the electromagnetic field over a large distance, they tend to be less sensitive to the precise position of the coin and therefore not particularly accurate at measuring coin geometry.

WO91/15003 discloses a validator for bimetallic coins in which first and second relatively small Hall effect sensors are provided, at different heights from, and positions along, a coin track so as to sense different portions of a coin simultaneously and the sensor outputs are thresholded to validate a coin.

U.S. Pat. No. 4,742,903 discloses a validator for bimetallic coins in which the outputs of several sensors along a coin track are separately derived and supplied, in time-division-multiplex form, for separate processing.

U.S. Pat. No. 4,870,360 discloses a coin validator in which a first Hall effect sensor is positioned on a coin track, and a second is positioned away from the track or adjacent to a reference coin, and the difference between the two sensor outputs (set to be null in the absence of a coin) is used to validate multi-metallic coins.

FR2538934 discloses a coin validator for testing for a single coin type in which first and second sensors are positioned along, at different heights from, and on opposite sides of, a coin track so as to sense different portions of a coin, and the sensor outputs are adjusted so that the difference there between is zero in the presence of a valid reference coin.

A test coin is validated by detecting the exact moment when a coin is symmetrically positioned adjacent to both sensors, and then sampling the magnitude of the difference between the sensor outputs and rejecting a coin if the magnitude is significant.

It does not validate bimetallic coins. Even if a multi-metallic coin were to be placed into the coin track, the sampled difference reading used to validate a coin represents the sensor outputs only at the instant when the coin is symmetrically positioned relative to the sensors, so that the coin material detected by each sensor would be identical, and the arrangement would therefore not be sensitive to the material differences within the multi-metallic coin.

SUMMARY OF THE INVENTION

Accordingly, the present invention provides a coin validator for multi-metallic coins comprising means defining a coin path for conveying coins to be tested, and a sensing circuit comprising two spaced magnetic sensors each substantially smaller in width than the diameter of a multi-metallic coin with which the validator is to be used, the sensors being positioned such that they are passed in succession by a coin travelling along the path, and so that they can be affected simultaneously by a coin passing the sensors, the circuit further including means responsive to the difference between the outputs of the sensors whilst respective regions of different metals of a coin are affecting the respective sensors, to determine whether signals provided thereby are representative of a genuine coin.

In this way, the circuit emphasises variations in material content thus sensed by the respective sensors, so that non-homogeneous coins produce distinctive outputs.

Each sensor is preferably formed by a respective inductance, although other types of sensor could be used (e.g. magnetoresistors, Hall effect devices, etc.) if suitable means are provided for generating a magnetic field. A single small-sized inductance would not have sufficient sensitivity to enable accurate discrimination between coins of different materials. However, by using two sensors and examining the differences between the outputs, sufficient sensitivity can be achieved. Any differences between the outputs can be magnified by amplifying the differential output, without the information content being buried in noise.

Preferably, the sensors are at the same distance from the coin track (i.e. are located at points on aligned parallel to the coin track). In this case, the signal representing the difference between the sensor outputs is symmetrical over time, because where a multi-metallic coin is rotationally symmetrical (as is usually the case) the same portions of the coin are seen by each of the sensors.

Preferably, the sensors are coupled in a bridge circuit, which provides a sensitive balance to the circuit. Preferably, the bridge circuit is balanced in the absence of a coin.

Preferably, the size of the sensors is of the order of the size of the portions of the coin made of each different metal; particularly, the sensors may correspond in size to the narrowest material portion of a coin.

Preferably, means are provided for adjusting the range of the output signal, as it is found that the output signal derived from ferrous coins can be much greater than the output signal derived from coins where no ferrous material is present.

The invention also extends to methods of validation using such a circuit. A validator according to the present invention is particularly suited for the detection and validation of multi-metallic coins, such as of the type mentioned above. However, the invention is not restricted to validation of this type of coin because the techniques have valuable other uses. For example, the sensing circuit can in addition or alternatively be used as an accurate coin diameter sensor.

BRIEF DESCRIPTION OF THE DRAWINGS

An arrangement embodying the invention will now be described by way of example with reference to the accompanying drawings, in which.

DETAILED DESCRIPTION

Figure 1:
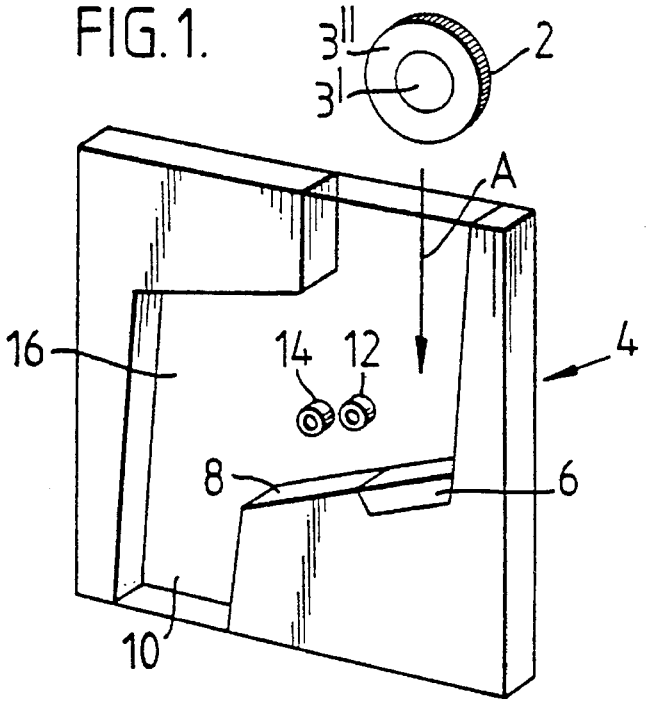
FIG. 1 schematically illustrates a flight deck of a coin validator in accordance with the invention.

Referring to FIG. 1, this is a schematic perspective view of the flight deck of a validator in accordance with the invention. Coins, such as the bimetallic coin illustrated at 2 which has a central core 3' and an outer ring 3", enter the validator 4 via a chute (not shown), and then fall in the direction of arrow A onto an energy-absorbing element 6. They then roll down a ramp 8 and enter an exit path 10.

As they roll down the ramp, the coins pass a pair of sensor inductances or coils 12,14, which are mounted within apertures in a rear wall 16 of the validator deck. The coils in this case are substantially circular in cross section, and each has a width of approximately 5 mm. Their centres are spaced apart by approximately 9 mm measured in a direction parallel to the surface of the ramp 8, i.e. parallel to the direction of travel of the coins. It is desirable that the coils be located at or close to a position at which the centres of the coins will pass the centres of the coils. For example, the centres of the coils may be mounted about 14 mm above the flight deck ramp, for coins of 28 mm diameter. The centres are spaced apart in a direction parallel to the direction of coin movement so that they are passed in succession. The sensors in this embodiment are spaced from the surface of the ramp 8 by the same distance, but this is not essential. The direction of separation could instead be inclined to the direction of coin movement. However in this case the sensor positioning is unlikely to be appropriate for as large a range of coin sizes.

Of course the above dimensions may vary, depending in particular upon the diameter of the coins for which the validator is to be used (i.e. the coins which the validator is set up to determine as acceptable). If the validator is to be used for validating bimetallic coins, then the sensors each preferably have a width which is no greater than the width of the outer ring of the smallest bimetallic coin with which the validator is to be used. The space between the coils preferably exceeds the largest outer ring width of the bimetallic coins with which the validator is to be used. In any event, it is desirable that the width of each sensor not exceed 25 percent of the diameter of the largest coin which the validator is intended to validate. The spacing between the coil centres is preferably smaller than the smallest coin which the validator is intended to validate.

Figure 2:
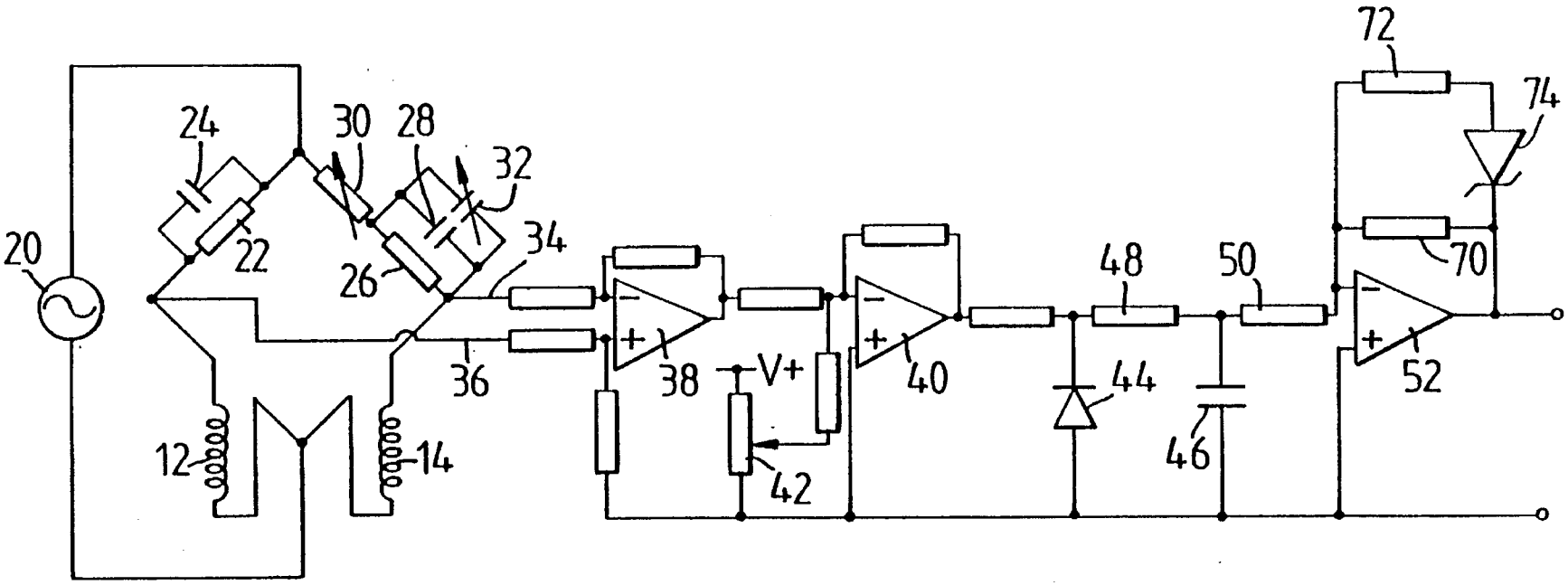
FIG. 2 is a circuit diagram of the sensor.

With reference to FIG. 2, it will be noted that the two coils 12 and 14 are connected in adjacent arms of a bridge circuit driven by an oscillator 20. A third arm of the bridge includes resistive and capacitive elements 22 and 24 coupled in parallel. The fourth arm of the bridge contains similar resistive and capacitive elements 26 and 28, together with further adjustable resistive and capacitive elements 30 and 32 which allow the bridge to be adjusted until it is accurately balanced in the absence of a coin.

The output terminals 34 and 36 of the bridge are coupled via respective resistors to the negative and positive inputs of a differential amplifier 38. The output of the amplifier 38 is fed to the negative input of a unity gain summing amplifier 40, this input also receiving an adjustable offset potential from a potentiometer comprising a variable resistor 42 coupled between earth and the supply voltage. The output of the summing amplifier 42 is coupled across a clamping diode 44. The purpose of the offset voltage added at the summing amplifier 40 is to enable the high frequency signal from the bridge circuit to be diode rectified without the need for large voltage amplification.

The output across the clamping diode 44 is fed through a low pass filter formed by capacitor 46 and resistors 48 and 50 to a high gain amplifier 52. The output of the amplifier is then sampled at predetermined intervals so that the waveform produced thereby can be examined to determine whether it is representative of an authentic coin. Various sampling techniques, which in themselves are known in the art, may be used.

Figure 3A:
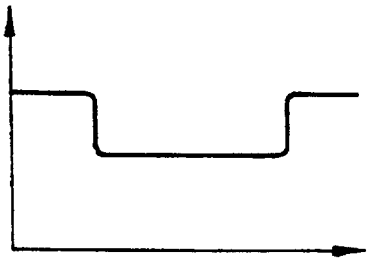
FIGS. 3A to 3D are waveform diagrams to illustrate the difference between the outputs produced by a sensor in a validator of the present invention, and those produced by a conventional sensor.

Referring to FIG. 3A, this shows the envelope of the waveform which would be derived from a conventional inductive sensor as an homogeneous coin passes. The vertical axis represents amplitude, and the horizontal axis represents time. The conventional sensor would have a size similar to that of the coin. The output amplitude of the sensor would fall as the coin entered the field of the sensor, and would rise again as the coin leaves the field.

Figure 3C:
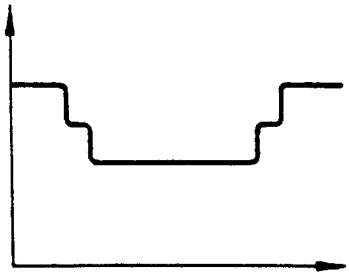
Figure 3B:
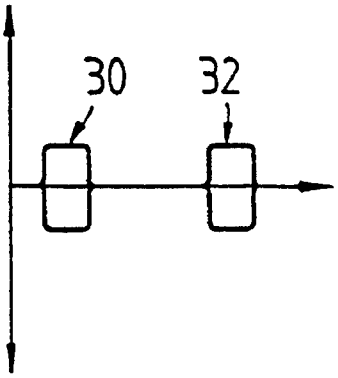

As shown in FIG. 3B, the output envelope presented to the rectifier in the circuit of FIG. 2 differs. The outputs of the individual sensors are equal and the bridge is in balance before the coin enters the fields and after the coin has left the fields, and while the sensors are both adjacent respective areas of the coin. Accordingly, the circuit output is zero at these times. However, while the coin is adjacent the first sensor, but has not yet reached the second sensor, and after the coin has left the first sensor but has not yet passed the second sensor, the outputs from the sensors differ substantially. Viewed in another way, where (as in this embodiment) the sensors are coils, the presence of the coin alters the impedance of the first sensor and thus unbalances the bridge circuit. Since the circuit output is responsive to the difference in coil impedance, and hence coil output, the two signal portions 30 and 32 are shown in FIG. 3B are derived. When the coils are energised at a suitable frequency (e.g. 100 KHz) the amplitude of each of these portions is dependent upon the material from which the coin is made. The time separating the two portions depends upon the diameter of the coin.

The output produced by a conventional sensor in response to the passage of a bimetallic coin is shown in FIG. 3C. Again, the level of the envelope shifts from an idling level prior to the coin entering the field to a lower level as the coin passes through the field, and then shifts back to the idling level. However, the envelope shifts to an intermediate level as the coin is entering and leaving the field. The intermediate level has a magnitude dependent upon the material of the outer ring of the coin, and the plateau at the centre of the envelope waveform has a level which is dependent upon the material of the central core of the coin.

However, in practice, it may be difficult with a conventional sensor to determine that the coin is a bimetallic coin. The intermediate levels at the beginning and end of the envelope waveform have a relatively short duration compared with the overall waveform. Even if they are sensed, it is difficult to determine whether the materials of the coin correspond to what would be expected of a genuine coin. As mentioned above, the heights of the different parts of the waveform will be indicative of the material properties, but they will also be influenced heavily by other factors such as the circuit constants, temperature, noise, etc.

In order to obtain a large enough signal-to-noise ratio, the coil is usually a similar size to the coin, and larger than the (relatively smaller) portions of the coin of different metals. Thus, the coil is usually simultaneously sensing regions of both metals, and the transition or edge regions will be shallow and indistinct.

Figure 3D:
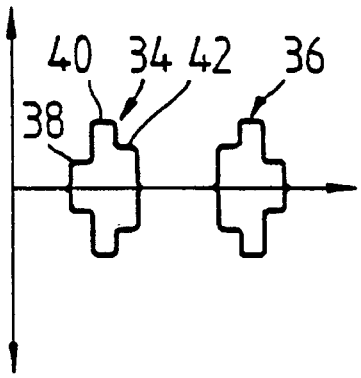

Referring to FIG. 3D, this shows the output of the sensor of the present invention in response to passage of a bimetallic coin. As can be seen, the waveform is very distinctive compared to that shown in FIG. 3B, as a result of which it is much easier to detect that the coin is bimetallic. The waveform again has two portions, 34 and 36, corresponding to the times at which the coin enters the sensor fields and when it leaves the sensor fields. The time between the two portions corresponds to the time at which both sensors are in proximity to the central core material of the coin, and therefore produce similar outputs which cancel each other. As the coin enters the first sensor field, the output of the first sensor changes compared with that of the second sensor so as to produce a level indicated at 38, which is dependent upon the nature of the outer ring material. Then, as the core of the coin approaches the first sensor, the level shifts to 40, which is dependent upon the core material. Then, as the outer ring approaches the second sensor, the level shifts to 42, which is dependent upon the relationship between the core and outer ring materials (e.g. the difference in lossiness between the materials). The level then shifts to zero as the core comes into proximity with the second sensor. As seen in FIG. 3D, the opposite effect occurs when the coin leaves the sensor.

Each of the portions 34 and 36 of the envelope waveform adopts a number of discrete levels which have a duration which is substantial compared with the overall duration of the waveform portion, and therefore which are relatively easy to detect. Also the different heights of the envelope portion, which correspond to the different materials, are less influenced by temperature, noise, etc. because of the differential configuration of the bridge circuit. Furthermore, although not clearly shown in FIG. 3 because of the schematic nature of the drawings, the intermediate levels of the conventional sensor waveform shown in FIG. 3C would be smoothed out to a much greater extent than the intermediate levels in the waveform according to this embodiment of FIG. 3D because of the greater size of the conventional inductance coil, which would make it less sensitive to localized variations in material content.

Although each of the coils 12 and 14 is small, sufficient sensitivity can be achieved by increasing the voltage gain of the sensor outputs; because the sensor circuit provides a differential output it has a large dynamic range and is relatively immune to noise and temperature effects. This is particularly so when the sensor circuit comprises a bridge circuit which is balanced in the absence of a coin. Accordingly, the sensitivity problems normally associated with the use of small coils may be avoided.

The output of the sensor circuit in the regions 34 and 36 of FIG. 3D is directly representative of the difference in material (or other) properties of the respective portions of a coin underlying the two sensors at any given time, and hence is a good indicator of coin type or validity where multi-metallic coins are to be validated. Similar difference information might be derivable from the output of a single sensor, indicated in FIG. 3C, but this would necessarily involve the subtraction of one large quantity from another to yield a small difference, which is, in the presence of circuit noise, quantising noise of the sampling means and other inaccuracies, inherently inaccurate.

It is found that some coins, in particular those with a ferromagnetic material content, may produce substantially higher outputs than other coins. If the circuit is designed to be used with such coins, then the sensitivity of the circuit to coins which produce smaller outputs is substantially lower. Accordingly, referring again to FIG. 2, in one embodiment the output amplifier 52 is provided with a variable gain. The amplifier is connected to a gain-determining feedback loop comprising a resistor 70 coupled in parallel with a series circuit comprising a resistor 72 and a Zener diode 74. The gain is normally determined primarily by the resistor 70, and is relatively high. However, when the input voltage exceeds a predetermined level, which corresponds to the breakdown voltage of the Zener diode 74, the resistor 72 is brought into effect, which thus substantially reduces the gain of the amplifier. This enables the circuit to be used with ferromagnetic coins while maintaining sensitivity for coins which produce a lower-level output.

The above-described arrangement may be sensitive to the distance of the coin from the coils as the coin passes the coils depending upon the coin size and energizing frequency. Accordingly, the circuit can be used for detecting the presence of raised outer rings or embossing on coins, and the invention extends to a method of detecting such embossing or outer rings in this manner. If desired, any of the techniques described in GB2254948; PCT/US92/08783, filed 15 Oct. 1992; or British Application 9209686.6 filed 6 May 1992 (Agents Ref: J.25133), the contents of all of which are hereby incorporated by reference, may be used so as to derive a measurement which is less sensitive to the spacing between the coils and the coin. This technique relies upon detecting the direction of a vector representing the effects on the reactance and loss measured by an inductive circuit due to the presence of a coin. To achieve this the output of the amplifier 38 may be sent to two phase detectors, one sampling the output in phase with the oscillator, and the other sampling the output in quadrature with this phase.

It will be noted that the sensor circuit provides a symmetrical output, as shown for example in FIG. 3D. For detecting material content, it is necessary only to look at one of the waveform portions. Preferably, the second waveform portion is examined, because it is likely that the coin flight would have become more stable by the time this output is produced.

Figure 4:
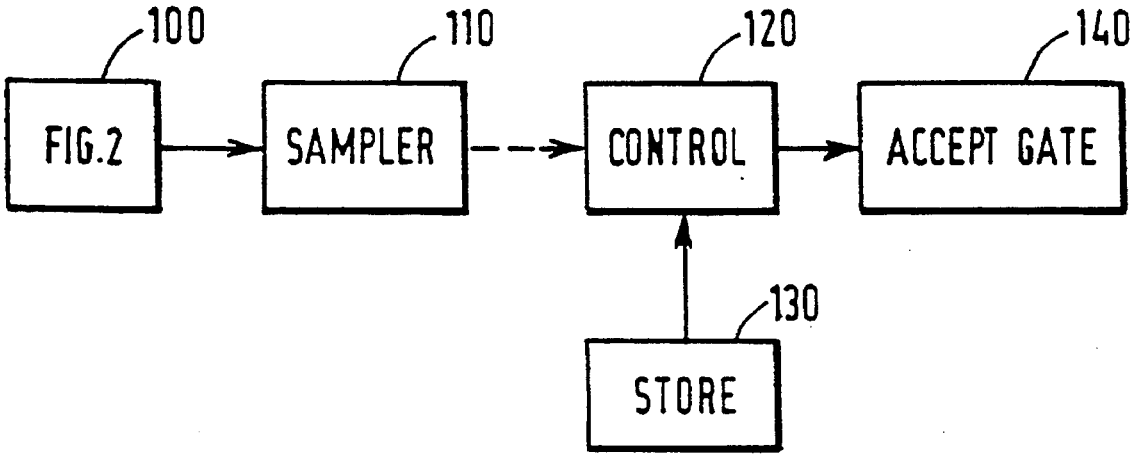
FIG. 4 is a block diagram illustrating the connection of the sensor of FIG. 2 into a validator.

Referring to FIG. 4, as discussed above, the output of the sensing circuit 100 comprising the circuit of FIG. 2 is sampled at predetermined intervals by a sampler 110 (comprising, typically, an analog to digital converter (ADC)), and the sampled output of the sampler 110 is supplied to a control circuit 120. The control circuit 120 may comprise, for example, a microprocessor or microcontroller programmable control circuit, with associated program storage ROM and working RAM memories, or may comprise a large scale integrated circuit (LSI).

Associated with the control circuit 120 is a store circuit 130 which is arranged to store, for each coin to be recognised, validation data which comprises data corresponding to the waveforms of FIG. **3*d* for each multi-metallic coin to be recognised. Typically, the data may comprise the amplitudes and widths of each of the portions 38, 40, 42 (or the corresponding portions of the second waveform portion 36); or the widths of the those portions; or a combination of both. The control means 120 is arranged to detect the waveform portions 38, 40, 42 by digital processing to locate, for example, points of inflection and relatively flat portions of the waveform. In one preferred embodiment, where the amplitudes of the portions 38, 40, 42 thus determined by the control means 120 are designated x,y,z the control means is arranged to determine whether or not these amplitudes correspond to those of a valid coin by forming a weighted sum of the measured amplitudes x, y, z and comparing the weighted sum with reference data in the store 130 (for example, upper and lower acceptance limits). In other words, the control means 120** is arranged to determine whether the following relationship is met:

$$Th_1<(Ax+By+Cz)<Th_2,$$

where $Th_1$ and $Th_2$ are stored thresholds corresponding to a coin type stored in the store 130, and A,B,C are constants for each coin type stored in the store 130.

If the above condition is met, the control means 120 activates an accept gate 140 of a type well known in itself, to accept the coin.

It will be seen that this technique is similar to that described in our earlier applications GB2238152 and WO91/06074, with the measured signal amplitudes x, y, z being employed in place of the independent coil output signals described therein, and accordingly the disclosure of those earlier applications is incorporated herein by reference.

Equally, other techniques could be employed; for example, a direct comparison of the measured value x, y, z and corresponding stored values held in the store 130 could be made to determine whether the coin corresponds to a given reference coin.

It will be appreciated from the above that the techniques of the present invention can be used for detecting the conductivity and/or permeability of a coin, the distribution of different materials in the coin, the diameter of the coin and/or the presence of a raised outer ring or embossing on the coin. Also, a validator according to the invention would provide effective protection against attempts to defraud the mechanism by inserting washers in place of genuine coins.

The term "coins" as used herein is intended to refer not only to genuine coins, but also to tokens which are generally coin-shaped and sized, and to other items which could be used in an attempt to operate coin- or token-operated machines.

We claim:

1. A coin validator for composite coins consisting of a first material core surrounded by one or more rings of one or more second materials comprising means defining a coin path for conveying coins to be tested, and a sensing circuit comprising two spaced magnetic sensors each substantially smaller in width than the diameter of a composite coin with which the validator is to be used, the sensors being positioned such that they are passed in succession by a coin travelling along the path, and so that they can be affected simultaneously by a coin passing the sensors, the circuit further including means responsive to the difference between the outputs of the sensors whilst respective regions of different metals of a coin are affecting the respective sensors, to determine whether signals provided thereby are representative of a genuine coin.

2. A validator according to claim 1 in which the sensors are positioned at approximately the same displacement from the path.

3. A validator as claimed in claim 1, wherein each sensor is an inductance.

4. A validator as claimed in claim 1, wherein the sensors are connected in respective arms of a bridge circuit.

5. A validator according to claim 1 in which the sensor outputs are substantially equal in the absence of a coin.

6. A method of determining the diameter of a coin, the method including the steps of;

causing a coin to move in succession past two magnetic sensors each having a width substantially smaller than the diameter of the coin, the sensors being positioned such that they are simultaneously influenced by the coin;

deriving a signal which represents the difference between the outputs of the sensors; and deriving the coin diameter from a measurement of the time between respective parts of the signal waveform.

7. A method according to claim 6 in which the step of causing said coin to move past the two sensors further comprises:

causing said coin to move past the two sensors comprising inductances.

8. A method according to claim 6 in which the step of causing said coin to move past the two sensors further comprises:

causing said coin to move past the two sensors connected in a bridge circuit.

9. A method according to claim 6 in which the step of deriving the signal which represents the difference between the outputs of the sensors further comprises:

deriving the signal such that the sensor outputs are substantially equal in the absence of a coin.

10. A method of validating a composite coin consisting of a core material surrounded by one or more rings of one or more second materials, the method comprising:

providing two spaced apart sensors for generating analog output, each sensor substantially smaller in width than the diameter of the coin;

passing the coin past the sensors so that, at a predetermined point in time, one of the sensors senses the first material core and the other senses one of said one or more rings of one or more second materials, the sensors thereby generating analog outputs of different magnitudes;

deriving a signal from the outputs of the two sensors having a variable amplitude, the amplitude representing the analog difference between the magnitudes of the outputs of the two sensors; and determining the presence of a composite coin from the magnitude of the signal.

11. A method according to claim 10, in which the step of passing the composite coin past the two sensors further comprises: causing said coin to move past the two sensors comprising inductances.

12. A method according to claim 10, in which the step of passing the composite coin past the two sensors further comprises:

causing said coin to move past the two sensors connected in a bridge circuit.

13. A method according to claim 10, in which the step of deriving comprises deriving the signal such that the sensor outputs are substantially equal in the absence of a coin.

* * * * *

UNITED STATES PATENT AND TRADEMARK OFFICE

CERTIFICATE OF CORRECTION

PATENT NO. : 5,609,234

DATED : March 11, 1997

INVENTOR(S) : Robert S. Walker and Timothy P. Waite

It is certified that error appears in the above-identified patent and that said Letters Patent is hereby corrected as shown below:

Col. 2, line 11, after "for", delete "multi-metallic coins" and insert --composite coins consisting of a first material core surrounded by one or more rings of one or more second materials--.

Col. 2, lines 14-15, delete "multi-metallic coin" and insert --composite coil--.

Col. 2, after line 67, insert:

--In another aspect, the invention provides a method of validating composite coins consisting of a core material surrounded by one or more rings of one or more second materials, the method comprising causing a said composite coin to move past magnetic sensor means substantially smaller in width than the diameter of the coin, the method comprising deriving a signal portion which represents the difference between the respective outputs of the sensor means at times when respective different regions of said coin of different materials are proximate said sensor means, and determining whether the waveform of the signal indicates the presence of a coin ring material which differs from the core material based on said signal portion.--

Col. 4, line 36, after "respective", insert --identical--.

UNITED STATES PATENT AND TRADEMARK OFFICE

CERTIFICATE OF CORRECTION

PATENT NO. : 5,609,234

DATED : March 11, 1997

INVENTOR(S) : Robert S. Walker and Timothy P. Waite

It is certified that error appears in the above-identified patent and that said Letters Patent is hereby corrected as shown below:

Col. 6, line 34, delete "PCT/US92/08783, filed 15 Oct. 1992; or British Application 9209686.6 filed 6 May 1992 (Agents Ref: J.25133)," and substitute --WO 93/21608; or GB 2266399,--.

Signed and Sealed this

Eighth Day of June, 1999

*Attest:*

Q. TODD DICKINSON

*Attesting Officer*

*Acting Commissioner of Patents and Trademarks*